United States Patent [19]

Komiya

[11] 4,377,916

[45] Mar. 29, 1983

[54] CHAIN-LIKE TOY OF TRIANGULAR HOLLOW PRISMS

[75] Inventor: Kenji Komiya, Tokyo, Japan

[73] Assignee: T & K Co., Ltd., Ageo, Japan

[21] Appl. No.: 285,009

[22] Filed: Jul. 20, 1981

[30] Foreign Application Priority Data

| | | | |
|---|---|---|---|
| Feb. 26, 1981 | [JP] | Japan | 56/25268[U] |
| Apr. 9, 1981 | [JP] | Japan | 56/50174[U] |
| May 1, 1981 | [JP] | Japan | 56/62629[U] |

[51] Int. Cl.[3] ..... A63H 33/00

[52] U.S. Cl. ..... 46/1 R; 403/93; 403/96; 411/525; 411/544; 273/153 S

[58] Field of Search ..... 46/1 R, 16, 22, 23, 46/26, 29, 173, 25, 24; 403/93, 94, 96, 97, 101, 92; 273/157, 153; 434/211

[56] References Cited

U.S. PATENT DOCUMENTS

| | | | |
|---|---|---|---|
| 2,584,451 | 2/1952 | Hopp | 403/96 |
| 2,609,251 | 9/1952 | Haupt | 403/97 |
| 2,653,415 | 9/1953 | Becker | 46/173 |
| 3,577,673 | 5/1974 | Monestier | 46/16 X |
| 3,597,872 | 8/1971 | Vennola | 46/1 R |
| 4,030,209 | 6/1977 | Dreiding | 46/29 X |

FOREIGN PATENT DOCUMENTS

| | | | |
|---|---|---|---|
| 7005541 | 2/1970 | Fed. Rep. of Germany | 46/24 |
| 1585436 | 4/1981 | United Kingdom | 46/25 |

*Primary Examiner*—F. Barry Shay

*Attorney, Agent, or Firm*—Frishauf, Holtz, Goodman & Woodward

[57] ABSTRACT

A chain-like toy made of a plurality of isosceles triangular hollow prism units that are connected serially with one another at slanted side planes thereof by means of a connecting rod interposed with a resilient member, each unit being connected rotatably for an angle of 360° so that various shapes of things can be simulated by rotating each of the triangular hollow prisms.

8 Claims, 9 Drawing Figures

CHAIN-LIKE TOY OF TRIANGULAR HOLLOW PRISMS

BACKGROUND OF THE INVENTION

The present invention relates to a chain-like toy comprising a plurality, preferably more than 20, of isosceles triangular prisms made of plastic that are rotatably connected at the equal side planes of the triangular prisms.

Each isosceles triangular prism unit consists of five planes or faces, i.e. a rectangular base plane, two isosceles triangular side plates erected symmetrically on the sides of the said base, and two rectangular planes slanted at an equal angle and interposed between the two triangular side plates. A plurality of the triangular prism units are rotatably connected in series at the slanted planes thereof by means of a connecting rod, the slanted planes being so connected as to arrange them in abutment. By rotating each unit suitably for an angle of 360°, any desired shape and form of things and animals can be made.

As a means to connect such triangular prism units rotatably in a series, a sturdy string may be passed through the units with a strain and fixed at both ends to the units. However, when such units are connected with a string, the connection will not hold strongly enough, the strain being applied as it were, and as the string slackens with time, the connection will be further weakened. As a result, units may rotate voluntarily while a player is making a certain shape by manipulating the units, rendering it impossible for him to maintain his intended shape. Another grave defect of this method is that the string may be worn and cut after frequent rotations where it comes in contact with the point of rotation. Furthermore, in assembling a toy, it is quite troublesome to fix the both ends of a string to units while maintaining it fully stretched. It may also pose a difficult problem of connecting each unit of all the products with a uniform strain.

In view of the above defects that may arise, it will be necessary to construct a toy such as this by a connecting means which may not be easily broken at the connecting points by frequent rotations and which may be imparted with a uniform strain.

SUMMARY OF THE INVENTION

An object of the present invention is to provide a toy of chained triangular prism units characterized in that the units will not be easily broken at the connecting points notwithstanding frequent rotations and rough handling, that all the units are firmly and securely connected with each other under a uniform strain, and that each unit may easily be connected.

According to one embodiment of the present invention, a unit is provided with a hole at the center of each slanted side planes that the holes of adjacent units may coincide with each other when abutted. Each units are then securely connected with one another in a freely rotatable manner by means of a rod which is attached with a head, e.g. a pin and inserted in the holes. More concretely, the said rod is provided with a resilient member such as a spring which may be attached before or after the rod is inserted in the holes. A push-nut in the shape of a dish is capped to the tip of the rod with the resilient member being compressed to a certain degree. The push-nut is made of a metal plate provided with a hole of a diameter slightly smaller than the outer diameter of the said rod; slits are formed along the circumference of the hole to provide a plurality of flaps in the shape of a nail. When the push-nut is capped to the tip of the said rod, the flaps are pushed open so that the inner periphery thereof will firmly bite into the outer circumference of the rod to be fixed thereto.

The connecting rod may be firmly fitted in the holes made in the slanted planes of two adjoining units as the push-nut is fixed to the tip of the rod. Further, the slanted planes will be abutted with each other over their entire area under a compression of the resilient member that is inserted to the rod. Therefore, when an individual unit is rotated under such a condition of connection, the unit being rotated may accurately sustain its desired angle of rotation.

As the construction of the present invention enables each triangular prism to be connected with one another in a freely and individually rotatable manner by means of a rod inserted with a resilient member at the connecting planes, such connection is rendered extremely firm, and even when more than 20 of such units are connected, there will be no such troubles as to cause the abutment of each unit to become loosened due to slackening of the connecting member. The present invention is further advantageous in that assembling of a product is very simple as it only requires to connect units by inserting a rod to holes made in the slanted planes of each unit and then attaching a push-nut to the tip of the rod.

The above and other objects and constructions of the present invention will become more apparent from the following description of the embodiments and accompanying drawings.

DESCRIPTION OF THE PREFERRED EMBODIMENTS

Figure 1:
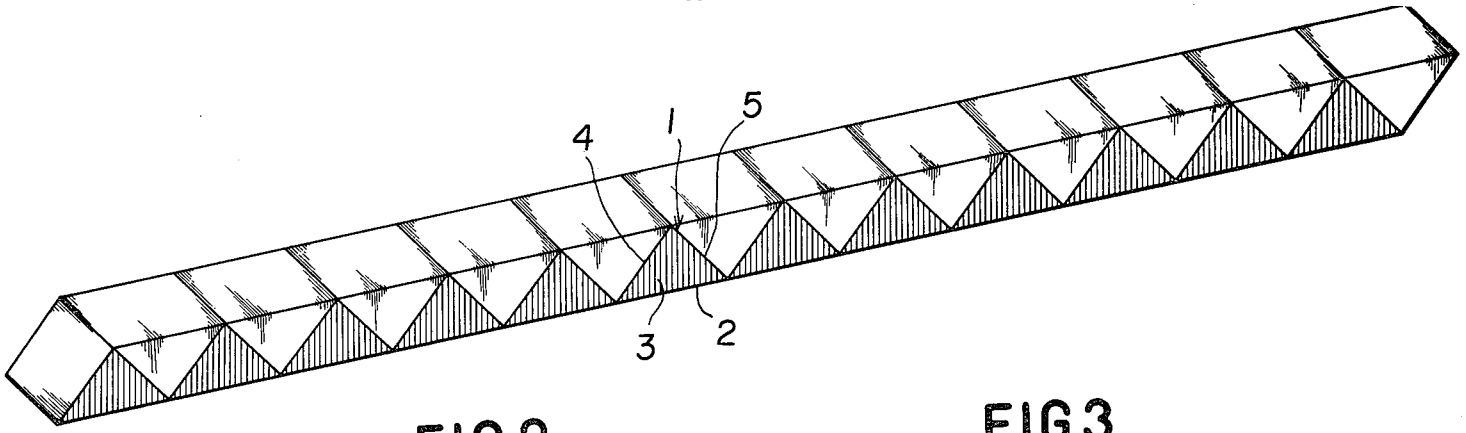
FIG. 1 is an oblique view showing the entire chain-like toy according to one embodiment of the present invention.
Figure 3:
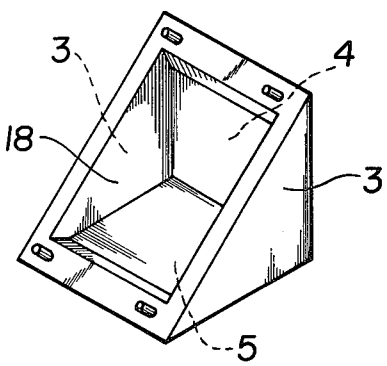
FIG. 3 is an oblique view showing another plane of the triangular prism.
Figure 2:
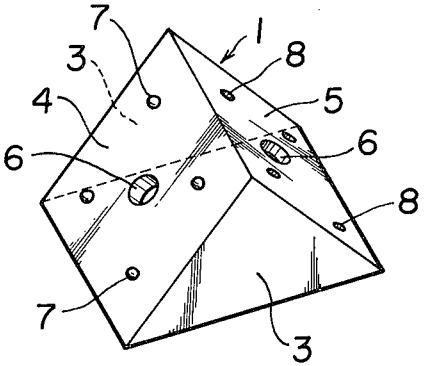
FIG. 2 is an oblique view of a triangular prism unit which constitutes the toy of the present invention.

The present invention will now be described with reference to the accompanying drawings. As shown in FIGS. 2 and 3, there are provided, for example, 24 units of hollow isosceles triangular prisms (1) equally divided into two different colors, the said triangular prism being made of synthetic resin and comprising one rectangular base plate (2), two side plates (3) of isosceles triangle provided on two opposing sides of the base plate (2) and two rectangular planes or faces (4) and (5) slanted at an equal angle and interposed between the said side plates. The two side plates (3) of isosceles triangle and the two rectangular slanted planes (4) and (5) are formed integrally as the hollow member unit (1) while the base plate (2) is formed separately and attached to the unit using glue or by means of insertion at an opening (18) at the base thereof after the hollow units (1) are connected in a manner as described hereunder.

A through-hole (6) is bored respectively at the center of two slanted planes (4) and (5), which are slanted at an equal angle, of a hollow unit (1); and at the periphery of one of the slanted planes (4) there are provided with 4 projections (7) at every 90° and at an equal interval around the said through-hole (6) while at the periphery of the other slanted plane (5) are provided with 4 dents (8) at positions corresponding to those of the projections (7) so that the projections (7) may be inserted in the dents.

As shown in FIG. 3, a hollow unit (1) of one color with its base plate (2) being removed is connected to another hollow unit (1) of different color and being inverted in such a manner that the projections (7) on the slanted plane (4) of one of the units (1) will fit in the dents (8) of the slanted plane (5) of the other unit (1), a pin (9) being inserted from the inside of one of the slanted planes to penetrate into the inside of the other slanted plane via the through-holes (6), (6) made in the slanted planes (4) and (5). (FIG. 4)

Figure 5:
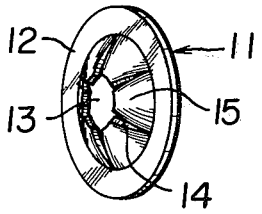
FIG. 5 shows an oblique view of a push-nut to be attached to the connecting rod.

The tip (16) of the pin (9) which is protruding into one of the slanted planes is first inserted with a coil-spring (10). Then, a push-nut (11) is set and, while pressing the said spring (10), the catching pin (15) of the push-nut (11) will be securely fitted to the pin (9) to allow the hollow units (1), (1) to be rotatable. The push-nut (11) comprises, as shown in FIG. 5, a metal plate (12), a through-hole (13) made in the center of the metal plate (12) and having a diameter slightly smaller than the outer diameter of the pin (9) and a plurality of slits (14) radially made in the circumference of the through-hole (13) to act as convex catching pins (15). When said push-nut (11) is fitted in the pin (9) and pushed forward by means of a tool, the tips of the catching pins (15) which constitute the inner circumference of the through-hole (13) will each bite into the outer circumference of the pin (9) at the tip (16) thereof to prevent the push-nut from slipping out of the pin (9).

A plurality of the abutting hollow units (1), (1) thus connected by means of the pin (9) are then provided with the base plate (2) in the opening (18) at the bottom of the hollow unit (1) by means of glue or an inserting and stopping means (17).

Figure 4:
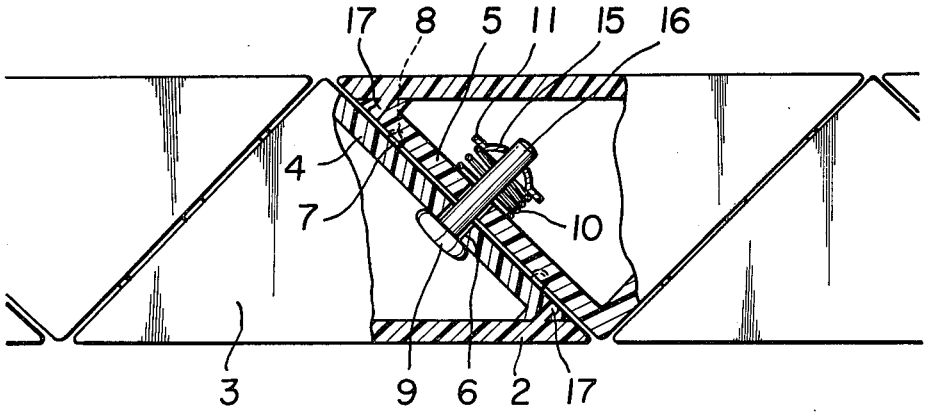
FIG. 4 is a partial vertical cross section to show the structure of the part of a unit to be connected.

Although FIG. 4 shows an embodiment in which the coil-spring (10) is inserted in the pin (9) after the pin (9) has been fitted in the through-holes (6) and then the push-nut (11) is fixed to the tip of the pin (9), the coil-spring (10) may be previously inserted to the pin (9) before fitting the same in the through-holes (6). In the latter case, the coil-spring (10) will be placed at a position opposite to that shown in FIG. 4, or, the coil-spring (10) is fitted at the head of the pin (9). However, its action and effect will differ in no way as compared with the case shown in FIG. 4 when the push-nut (11) is fitted to the tip of the pin (9) and the coil-spring will tightly secure the connecting rod.

Figure 6:
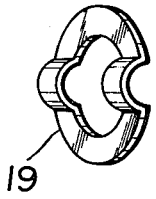
FIG. 6 is an oblique view of another embodiment of a spring member for use in the invention.

The spring means is not limited to the coil-spring as mentioned above, but a plate-spring (19) having a wave-like surface as shown in FIG. 6, may be used. It may also be a thick rubber packing. The resilient member such as these will give an adequate contacting force to the two slanted planes (4) and (5) in abutment. When the hollow units (1) are rotated, the projections (7) and the dents (8) provided respectively on the slanted planes (4) and (5) will slide for a predetermined range of angle at every 90° while the dents and the projections being disengaged. This sliding will be smooth as the resilient member renders an adequate compressing force. Therefore, when the hollow units (1) are rotated at every 90° to a predetermined position to stay, the projections (7) and the dents (8) will again catch with one another by this compressing force of the resilient member, to allow the hollow units (1) to be maintained securely at an accurate angle.

Figure 7:
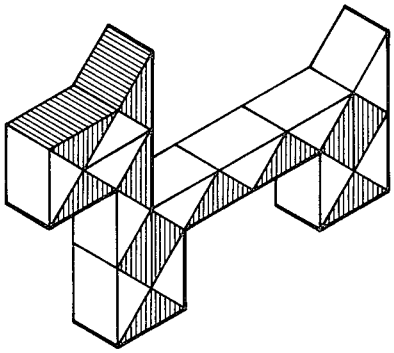
FIGS. 7 through 9 are oblique views to show the chain-like toy according to the present invention.
Figure 8:
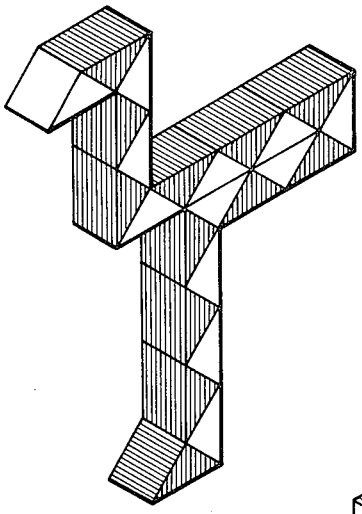
Figure 9:
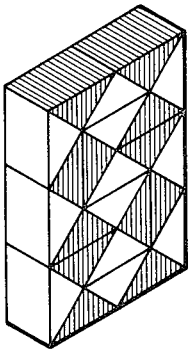

The chain-like toy of hollow triangular prisms according to the present invention comprises a plurality of hollow units (1) of isosceles triangular prisms, the prisms being connected rotatably by means of a pin (9) fitted to penetrate the slanted planes (4) and (5). This construction allows each hollow unit (1) to freely rotate and change its position with respect to the hollow unit (1) adjacent thereto, and by varying their relative positions, a variety of shapes of things as shown in FIGS. 7–9 may, for example, be made.

What is claimed is:

1. A continuously chained toy comprising:

a plurality of isosceles triangular hollow prism units (1), each hollow prism unit comprising first and second slanted faces (4, 5) slanted at an equal angle, a through-hole (6) at the center of each of the slanted faces, projections (7) provided on a first of said slanted faces (4) around said through-hole (6), and indentations (8) provided on the second of said slanted faces (5) at positions corresponding to the positions of the projections (7); and means for assembling said hollow prism units (1) adjacent one another with a first slanted face (4) of one hollow prism unit in abutment with the second slanted face (5) of the adjacent hollow prism unit, said assembling means including a plurality of connecting means, each connecting means independently connecting adjacent hollow prism units, and each connecting means including a pin (9) mounted in and extending through the through-holes (6) of only a pair of the adjacent slanted faces of a pair of adjacent hollow prism units, said pin terminating at an end interior of a respective hollow prism unit, resilient means (10) mounted on said pin (9) and located interior of at least one of the adjacent hollow prism units and on a side of at least one of said slanted faces which does not face the slanted face of the adjacent hollow prism unit, and a push-nut (11) located interior of at least one of the adjacent hollow prism units and mounted on a free end of said pin (9) and compressing said resilient means to connect a hollow prism unit (1) rotatably with respect to the adjacent hollow prism unit, said resilient means applying a resilient biasing force relative to said slanted faces in the axial direction of said pin (9), said push-nut (11) having an opening (13) in the center thereof which has a diameter slightly smaller than the outer diameter of said pin, said push-nut being fitted on said pin with an interference fit between said pin and said opening (13).

2. The continuously chained toy of claim 1 wherein said resilient means comprises a coil-spring mounted on said pin (9) after said pin (9) is fitted into said through-holes (6) in said slanted faces of adjacent hollow prism units, said push-nut (11) being attached to the free end of said pin (9) and in contact with said coil spring.

3. The continuously chained toy of claim 1 wherein said pin is a headed pin, and said resilient means comprises a coil-spring mounted on the headed side of said pin (9) before said pin (9) is fitted into said through-holes (6) in said slanted faces of adjacent hollow prism units, said push-nut (11) being attached to the free end of said pin (9) after it is inserted into said through-holes (6) of adjacent slanted faces.

4. The continuously chained toy of claim 1 wherein said resilient means comprises a plate-spring having a wave-like surface.

5. The continuously chained toy of claim 1 wherein said resilient means comprises a thick rubber packing.

6. The continuously chained toy of claim 1 wherein said resilient means comprises a coil-spring.

7. The continuously chained toy of any one of claims 1, 2 or 3, wherein said push-nut (11) is of a dish-form.

8. The continuously chained toy of claim 1, wherein said projections (7) provided on a first of said slanted faces (4) are arranged at a regular interval and at approximately every 90° centering around said through-hole (6).

* * * * *